US006202849B1

(12) United States Patent
Graham

(10) Patent No.: US 6,202,849 B1
(45) Date of Patent: Mar. 20, 2001

(54) EVACUATABLE RIGID STORAGE UNIT FOR STORING COMPRESSIBLE ARTICLES THEREIN

(76) Inventor: David B. Graham, 15 Knoll Dr., Suisun, CA (US) 94585

( * ) Notice: Subject to any disclaimer, the term of this patent is extended or adjusted under 35 U.S.C. 154(b) by 0 days.

(21) Appl. No.: 09/348,982

(22) Filed: Jul. 7, 1999

(51) Int. Cl.[7] ..... B65D 81/20
(52) U.S. Cl. ..... 206/524.8; 220/62.21
(58) Field of Search ..... 206/524.8, 525, 206/526, 278, 499; 383/43, 44, 45, 63, 100, 103; 53/403, 432, 436, 79; 220/495.06, 62.2, 62.21

(56) References Cited

U.S. PATENT DOCUMENTS

| | | | | |
|---|---|---|---|---|
| 2,364,012 | * | 11/1944 | Walton et al. | 206/524.8 |
| 2,913,030 | | 11/1959 | Fisher . | |
| 3,061,165 | * | 10/1962 | Rench et al. | 206/524.8 |
| 3,351,270 | | 11/1967 | Hohnjec . | |
| 3,403,696 | | 10/1968 | Pynchon . | |
| 3,454,182 | | 7/1969 | Morton . | |
| 3,574,306 | | 4/1971 | Alden . | |
| 3,620,409 | * | 11/1971 | Rosenbaum | 206/524.8 |
| 3,958,693 | | 5/1976 | Greene . | |
| 4,082,201 | | 4/1978 | Bittel . | |
| 4,209,485 | | 6/1980 | Greenspan . | |
| 4,372,921 | | 2/1983 | Sanderson et al. . | |
| 4,640,080 | * | 2/1987 | Wright | 206/524.8 |
| 4,712,574 | | 12/1987 | Perrott . | |
| 4,712,711 | * | 12/1987 | Geering et al. | 220/62.21 |
| 4,747,702 | | 5/1988 | Scheibner . | |
| 4,778,282 | | 10/1988 | Borchardt et al. . | |
| 4,871,264 | | 10/1989 | Robbins, III et al. . | |
| 5,063,639 | | 11/1991 | Boeckmann et al. . | |
| 5,080,155 | | 1/1992 | Crozier . | |
| 5,142,970 | | 9/1992 | ErkenBrack . | |
| 5,203,458 | | 4/1993 | Cornwall . | |
| 5,209,264 | | 5/1993 | Koyanagi . | |
| 5,242,516 | | 9/1993 | Custer et al. . | |
| 5,246,114 | * | 9/1993 | Underwood | 206/524.8 |
| 5,282,322 | | 2/1994 | Kasuya . | |
| 5,368,394 | | 11/1994 | Scott et al. . | |
| 5,371,925 | | 12/1994 | Sawatsky . | |
| 5,397,182 | | 3/1995 | Gaible et al. . | |
| 5,402,906 | * | 4/1995 | Brown et al. | 206/524.8 |
| 5,480,030 | | 1/1996 | Sweeney et al. . | |
| 5,540,500 | | 7/1996 | Tanaka . | |
| 5,689,866 | | 11/1997 | Kasai et al. . | |
| 6,074,677 | * | 6/2000 | Croft | 206/524.8 |

FOREIGN PATENT DOCUMENTS

| | | |
|---|---|---|
| 3917344 | 11/1990 | (DE) . |
| 4-36940 | 6/1992 | (JP) . |
| 4-189752 | 7/1992 | (JP) . |
| 4-242544 | 8/1992 | (JP) . |

* cited by examiner

*Primary Examiner*—Luan K. Bui
(74) *Attorney, Agent, or Firm*—Limbach & Limbach LLP

(57) ABSTRACT

An evacuatable storage unit that includes a substantially rigid container having an open upper end, a flexible air tight liner attached to the inside of the container, and a port installed in a surface of the liner that allows air to pass out of the liner and prevents air from entering the liner. The liner has an upper portion that extends out beyond the open upper end of the container. The liner upper portion terminates in an opening for inserting compressible articles into the liner. The opening is closable to form an air tight seal. As air inside the liner is evacuated from the liner through the port (typically by using a household vacuum cleaner), the liner upper portion and compressible articles stored therein collapse into the container.

4 Claims, 9 Drawing Sheets

EVACUATABLE RIGID STORAGE UNIT FOR STORING COMPRESSIBLE ARTICLES THEREIN

FIELD OF THE INVENTION

The present invention relates to storage of compressible articles, and more particularly to a substantially rigid evacuatable storage unit that conveniently stores compressible articles having an uncompressed volume far exceeding the volume of the storage unit.

BACKGROUND OF THE INVENTION

Compressive sealable bags have been developed to reduce the volume needed to store compressible articles such as clothing, pillows, bedding, etc. Such bags have an opening through which the articles can be placed into the bag. The opening is then temporarily or permanently sealed. Air is evacuated from the bag through a one way check valve, thus compressing the compressible articles and reducing their overall volume. Not only does compressing the stored articles save storage space in suitcases, cupboards and closets, but also the removal of excess air inhibits the growth of insects and bacteria which can damage the contents of the bag, and any buildup of moisture that could cause mildew.

U.S. Pat. No. 5,540,500 illustrates one such storage bag. The bag has an open end sealed by sealing fasteners, and a flat pipe one-way check valve. Once the compressible articles are placed inside the bag and the sealing fasteners are sealed together, the bag is pressed or rolled to discharge the air contained in the bag out through the check valve. The volume of the compressed articles in the bag is significantly smaller than their uncompressed volume.

U.S. Pat. No. 5,480,030 also illustrates a compressive storage bag, having a sealable opening through which to insert compressible articles, and a one-way valve in the surface of the bag. The one-way valve is compatible with the cylindrical attachment of a household vacuum cleaner, which can be used to evacuate the air out of the bag once it is sealed.

Such compressive bags have several shortcomings. Compressible articles often do not compress down into a flat shape, making it difficult to stack multiple compressive bags on top of each other without toppling over. Further, compressed bags stored over long periods of time may allow air to slowly leak back into the bags, thus resulting in a slowly expanding volume of storage space taken up by the compressed bag. Moreover, compressive bags are made from a pliable plastic film that can be punctured with rough handling or by contact with sharp objects. The plastic film material can also lose its vacuum sealing integrity as it ages. Thus, articles stored over long periods of time could expand in volume and lose the vacuum protection from the bag, possibly without being detected for some time.

There is a need for a sealable compressive container that stores compressible articles in a stackable manner, provides superior protection against accidental puncture, and will not expand even if the vacuum integrity of the container is compromised.

SUMMARY OF THE INVENTION

The present invention solves the aforementioned problems by providing an evacuatable storage unit that draws compressible articles into a rigid container to provide superior protection and more reliable long term vacuum storage.

The evacuatable storage unit of the present invention includes a substantially rigid container having an open upper end, and a flexible air tight liner attached to an inside of the container. The liner has an upper portion that extends out beyond the open upper end of the container. The liner upper portion terminates in a first opening for inserting compressible articles into the liner. The first opening is closable to form a first air tight seal. As air inside the liner is evacuated from the liner, the liner upper portion and compressible articles stored therein collapse into the container.

In another aspect of the present invention, the evacuatable storage unit includes a substantially rigid container having an open upper end, a flexible air tight liner attached to an inside of the container, and a port installed in a surface of the liner that allows air to pass out of the liner and prevents air from entering the liner. The liner has an upper portion that extends out beyond the open upper end of the container. The liner upper portion terminates in an opening for inserting compressible articles into the liner. The opening is closable to form an air tight seal. As air inside the liner is evacuated from the liner through the port, the liner upper portion and compressible articles stored therein collapse into the container.

In yet another aspect of the present invention, the evacuatable storage unit includes a substantially rigid container having an open upper end, a flexible air tight liner having a lower portion terminating in a first opening that is attached to an inside surface of the container in an air tight manner and an upper portion that extends out beyond the open upper end of the container and terminating in a second opening for inserting compressible articles into the liner, and a port installed in a surface of at least one of the liner and the container that allows air to pass out of the liner and prevents air from entering the liner. The second opening is closable to form an air tight seal. As air inside the liner is evacuated through the port, the liner upper portion and compressible articles stored therein collapse into the container.

Other objects and features of the present invention will become apparent by a review of the specification, claims and appended figures.

DETAILED DESCRIPTION OF THE PREFERRED EMBODIMENTS

The present invention is a rigid evacuatable storage unit for storing compressible articles to save storage space and to provide superior protection for the stored compressed articles. The storage unit conveniently stores articles have an uncompressed volume far exceeding the volume of the storage unit.

Figure 1:
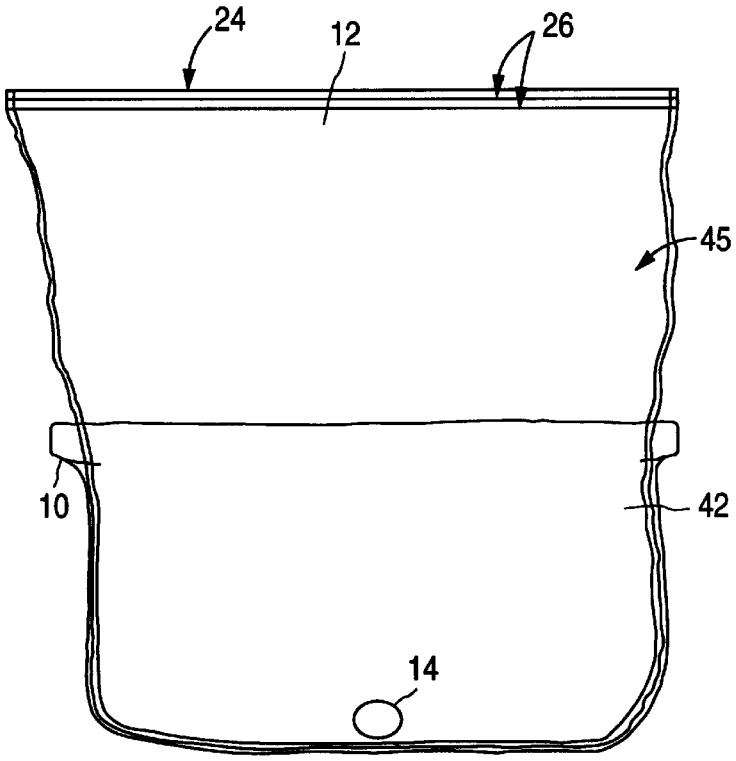
FIG. 1 is a side view of the evacuatable storage unit of the present invention.
Figure 2:
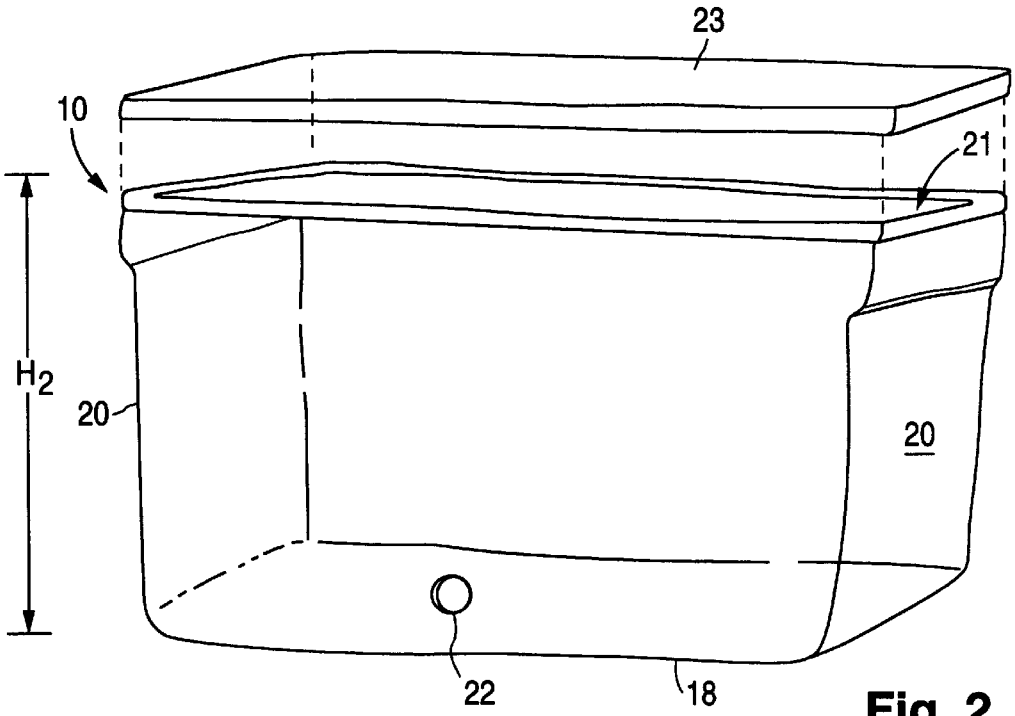
FIG. 2 is a side perspective view of the rigid container of the present invention.

The storage unit of the present invention is illustrated in FIGS. 1–3, and includes a substantially rigid container 10, an evacuatable liner 12, a hollow port 14, and a lid 23.

The container 10 includes a bottom wall 18, side walls 20, an open end 21 and an aperture 22, as illustrated in FIG. 2. The container 10 is made of any substantially rigid material, examples of which include plastic, rubber, corrugated paper products, wood, and metal. Lid 23 attaches over the container's open end 21.

Figure 3A:
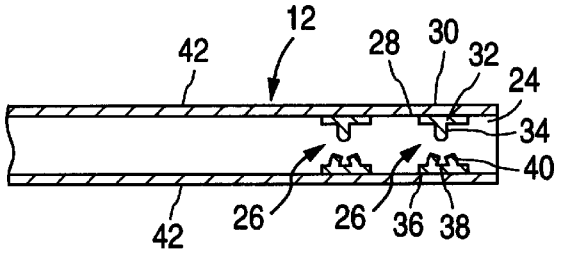
FIG. 3A is a cross-sectional view of the open end of the liner illustrating the sealing fasteners.
Figure 3B:
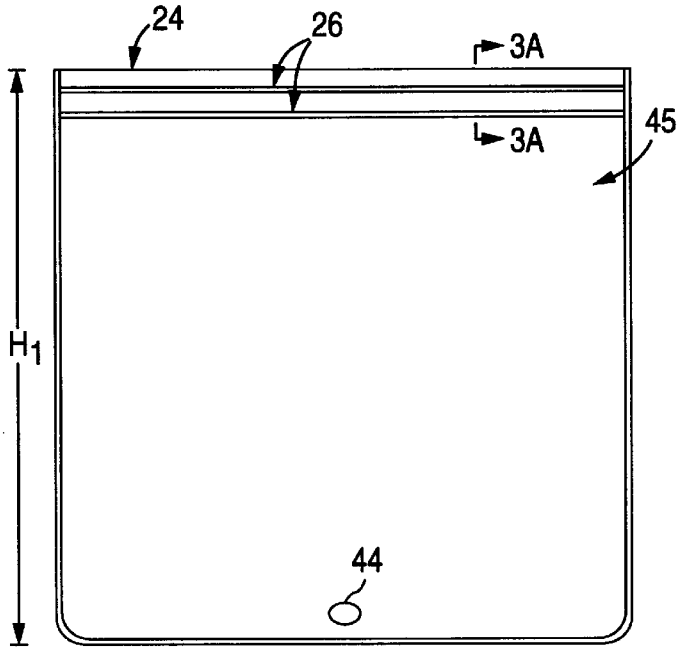
FIG. 3B is a side view of the liner of the present invention.

The liner 12 is bag shaped having an open end 24 that is repeatedly sealable using two sealing fasteners 26, as illustrated in FIGS. 3A and 3B. Each sealing fastener 26 includes a male fastener member 28 (provided with a flat base 30 and a linear protrusion 32 terminating in an enlarged head portion 34), and a female fastener member 36 (provided with a flat base 38 and a linear groove 40 which receives tightly the enlarged head portion 34 in a detachable manner). The male and female fastener members 28/36 are mounted on the inner surfaces of the liner walls 42 near the open end 24. An aperture 44 is formed in one of the liner walls 42. Preferably, the liner 12 has a height $H_1$ that is much greater than the height $H_2$ of the container 10, so that an upper portion 45 of liner 12 extends out beyond the open end 21 of container 10.

Liner 12 is made of any flexible material that is impervious to air, such as O-nylon, C-nylon, polyethylene, bi-axial nylon, polyurethane, polyester, PET, polypropelene, aluminum, etc., as well as multi-laminates of the same or different materials. The liner 12 is disposed in container 10 as illustrated in FIG. 1, so that apertures 22/44 are aligned to each other. Liner 12 is secured to bottom wall 18 and all side walls 20 by an adhesive to prevent the liner from pulling up away from the bottom wall 18 while the liner is being evacuated, which would reduce the collapsing effect of the articles into the container 10 and waste space during use, as described below.

The hollow port 14 is disposed in apertures 22/44 in such a manner that there is an air tight seal between port 14 and aperture 44 in liner 12. Preferably, port 14 is heat sealed and/or attached by adhesive to both the liner 12 and the container 10.

Figure 4A:
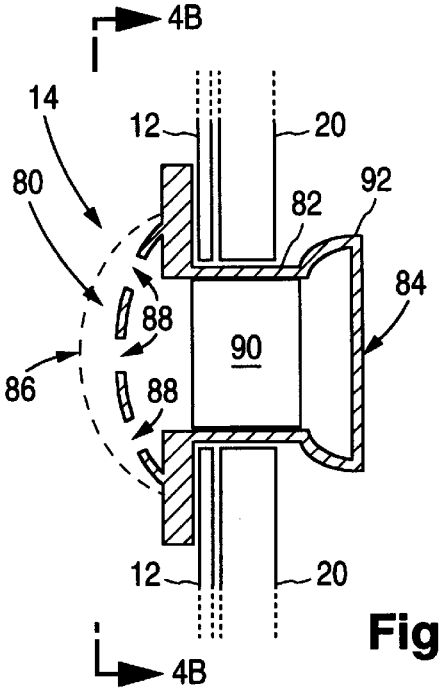
FIG. 4A is a cross-sectional view of the air port of the present invention.
Figure 4B:
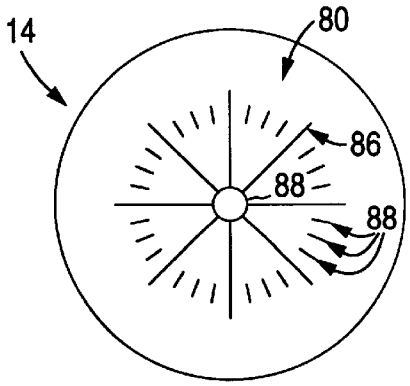
FIG. 4B is a side view of the port's inlet of the present invention.

Port 14 includes an inlet 80, a central body 82 and an outlet 84, as illustrated in FIGS. 4A–4B. The inlet 80 includes a plurality of elevated ridges 86 that extend above a plurality of holes 88 which lead to the interior of the central body 82. The elevated ridges 86 prevent the articles inside liner 12 from being pulled tightly against and sealing off holes 88 while air is evacuated from liner 12.

The central body 82 includes a one-way air check valve 90 that allows air to pass from inlet 80 to outlet 84, but not vice versa. There are a variety of well known one-way air valves available on the market that can be installed inside central body 82 to allow air flow in only one direction through port 14. One example is illustrated in U.S. Pat. No. 5,480,030, which is hereby incorporated by reference. Thus, one-way valve 90 is not further described herein because it is not critical to the present invention which of the currently available one-way valves are used in port 14, so long as it prevents air from travelling from outlet 84 to inlet 80.

Outlet 84 has a flange 92 that forms a receptacle that extends out from aperture 22 for receiving the cylindrical attachment hose from a common household vacuum cleaner.

Figure 5A:
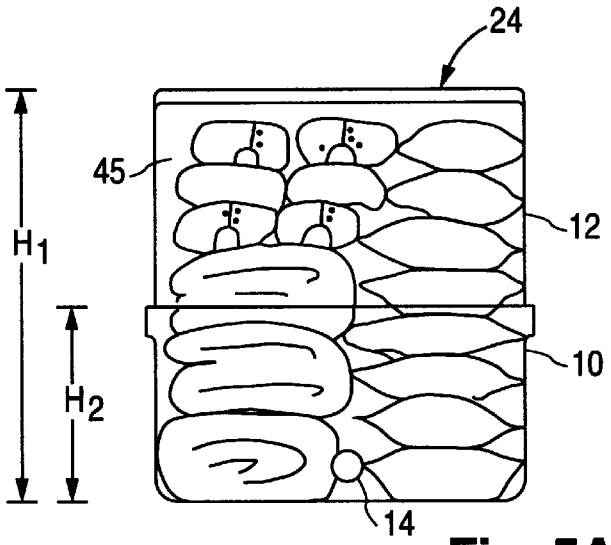
FIGS. 5A–5C are side views of the storage unit of the present invention, illustrating the compression of articles inside the liner as a vacuum source evacuates air from the liner.
Figure 5B:
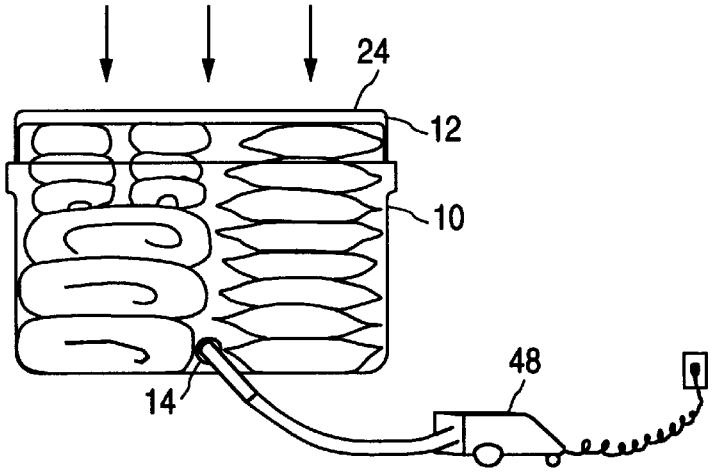
Figure 5C:
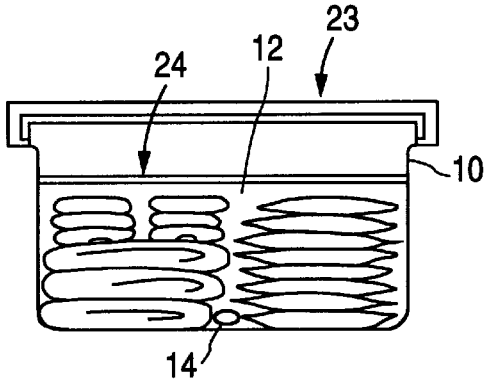

Operation of the storage unit of the present invention is illustrated in FIGS. 5A–5C. First, articles are placed inside liner 12 through open end 24, preferably filling the entire height $H_1$ of the liner 12, as illustrated in FIG. 5A. The sealing fasteners 26 are then closed by engaging the male fastener members 28 with the corresponding female fasteners 36. A vacuum source, such as a household vacuum cleaner 48, is attached to flange 92 of port 14. When the vacuum source is activated, air is withdrawn from liner 12 thus compressing the upper portion 45 of liner 12, and the articles stored therein, into the container 10. If no vacuum source is available, the liner can be evacuated of air manually by pressing the liner down and into the container 10. Once the liner upper portion 45 and compressible articles are fully collapsed into the container, the lid 23 is placed on the container 10, which is now ready for storage. The one-way valve in port 14 prevents air from re-entering liner 12. A sealing cap can be screwed or snapped onto the port 14 to increase the long term vacuum integrity thereof.

If $H_1$ of liner 12 is greater than the height $H_2$ of container 10, then articles having a greater volume than the container can be compressed into the volume of the container 10. In the preferred embodiment, $H_1$ is 3 feet, and $H_2$ is 1.5 feet. Thus, the articles are compressed to less than half their original height by the vacuum from the vacuum source. The present invention is ideal for collapsing and storing compressible items such as pillows, blankets, bedding, sweaters, comforters, sleeping bags, jackets, parkas, skiing or hunting clothes, stuffed animals, foam cushions, life vests, etc. Lid 23 tightly and securely attaches over the container's open end 21. Once the lid 23 is secured onto the container 10, the articles, liner 12, sealing fasteners 26, and check valve 90 are all protected by the strength and integrity of the rigid container 10. If for some reason the air tight integrity of the liner 12 is compromised and air leaks back into liner 12, container 10 and lid 23 attached securely thereto will help contain the compressed articles inside the volume of rigid container 10.

Figure 6A:
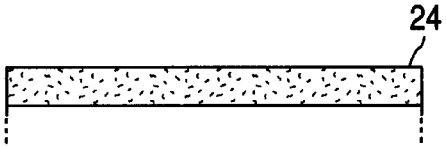
FIGS. 6A–6G are views of the open end of the liner, illustrating alternate ways of sealing the liner's open end.
Figure 6B:
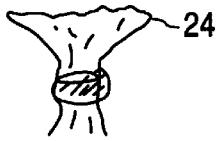
Figure 6C:
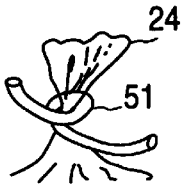
Figure 6D:
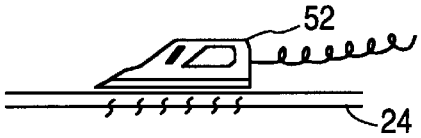
Figure 6E:
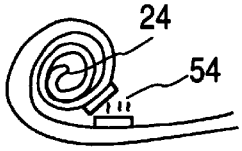
Figure 6G:
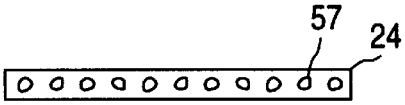
Figure 6F:
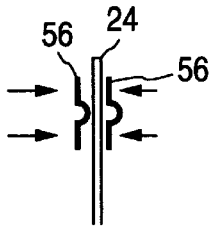

While the sealing fasteners 26 provide reliable and repeatable sealing of liner 12, FIGS. 6A–6G illustrate alternate ways of sealing open end 24, such as adhesive applied to the liner walls adjacent open end 24 (FIG. 6A), by tying open end 24 in a knot (FIG. 6B), by tying the open end 24 closed using string, rope or a twist tie 51 (FIG. 6C), by applying heat to the open end 24 using a household iron 52 to form a hermetic seal (FIG. 6D), by rolling up open end 24 and using hook and fabric connectors 54 to keep it from unrolling (FIG. 6E), by clamping the open end closed using elongated mating clamps 56 (FIG. 6F), or by using buttons or snaps 57 (FIG. 6G).

Figure 7:
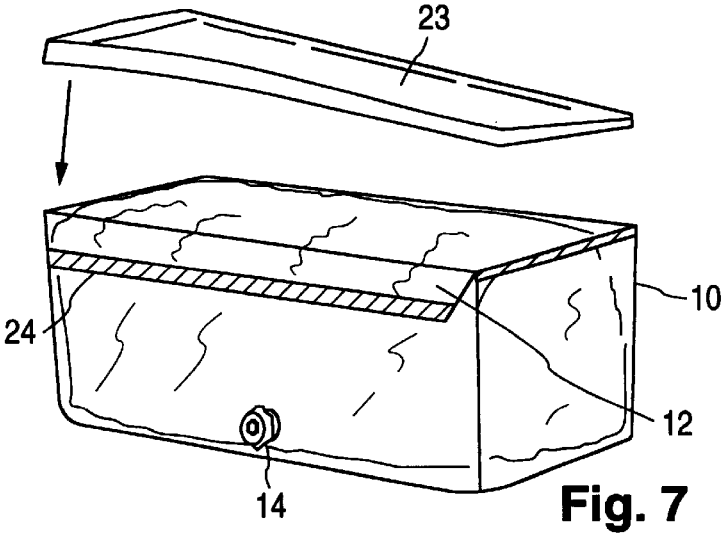
FIG. 7 is a perspective view illustrating how the lid can be used to pinch off and seal the open end of the liner.
Figure 8A:
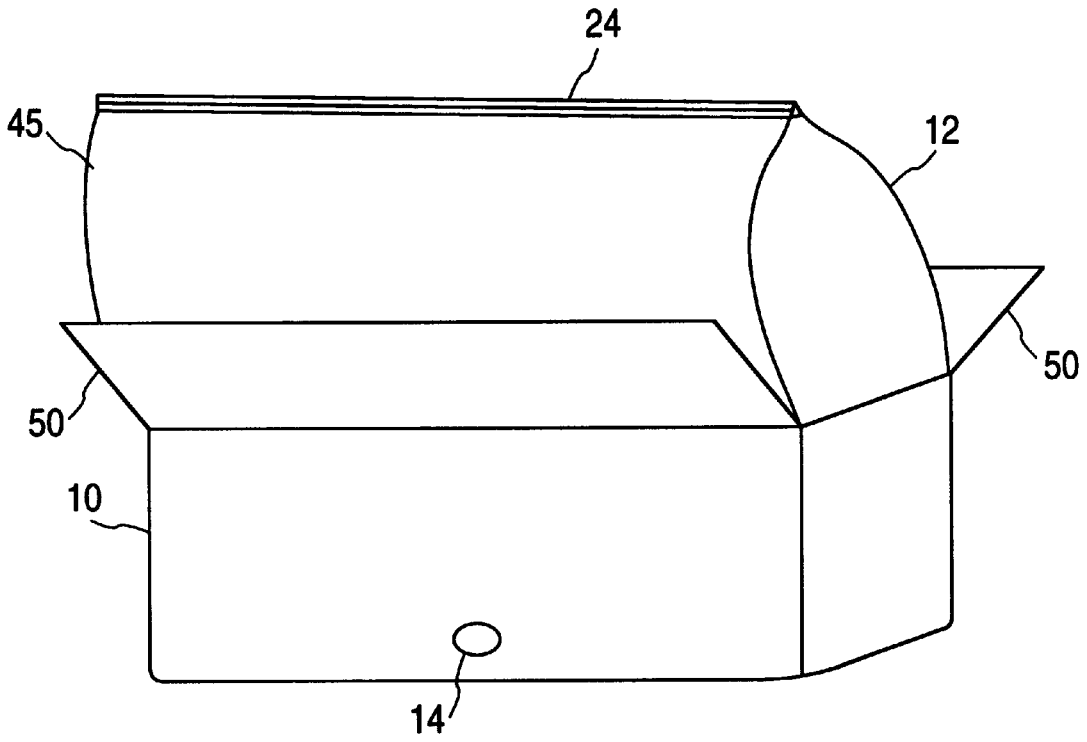
FIGS. 8A–8B are side perspective views of an alternate embodiment of the storage unit of the present invention, illustrating flaps on the container that pinch closed the open end of the liner.
Figure 8B:
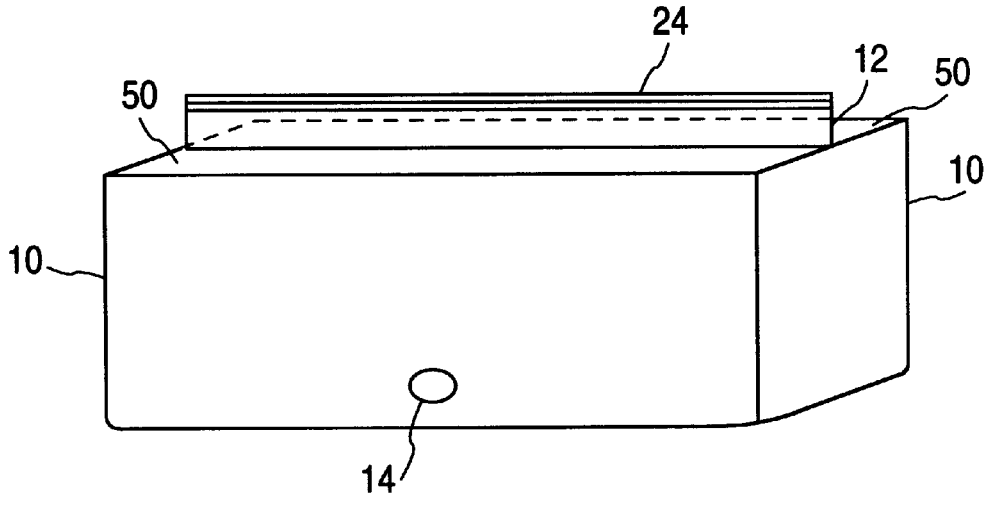

To increase the integrity of the liner seal, or possibly even eliminate sealing fasteners 26, open end 24 can be placed over the upper edge of container 10 so that lid 23 pinches liner 12 closed when lid 23 is placed on container 10, as illustrated in FIG. 7. Alternately, lid 23 can be in the form of flaps 50 foldably attached to the top of container 10, which pinch liner 12 near open end 24 when the flaps 50 are closed, as illustrated in FIGS. 8A–8B.

Figure 9A:
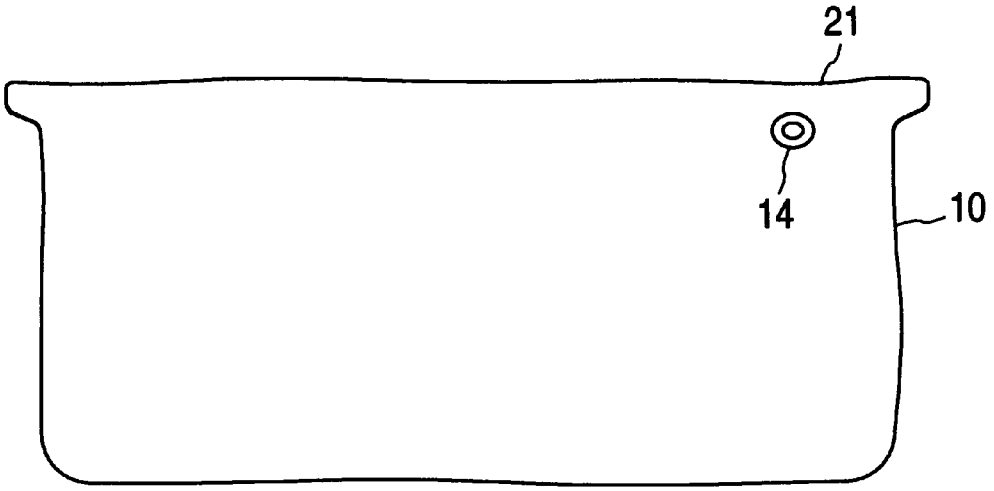
FIG. 9A is a side view of the storage unit illustrating an alternate location of the port.
Figure 9B:
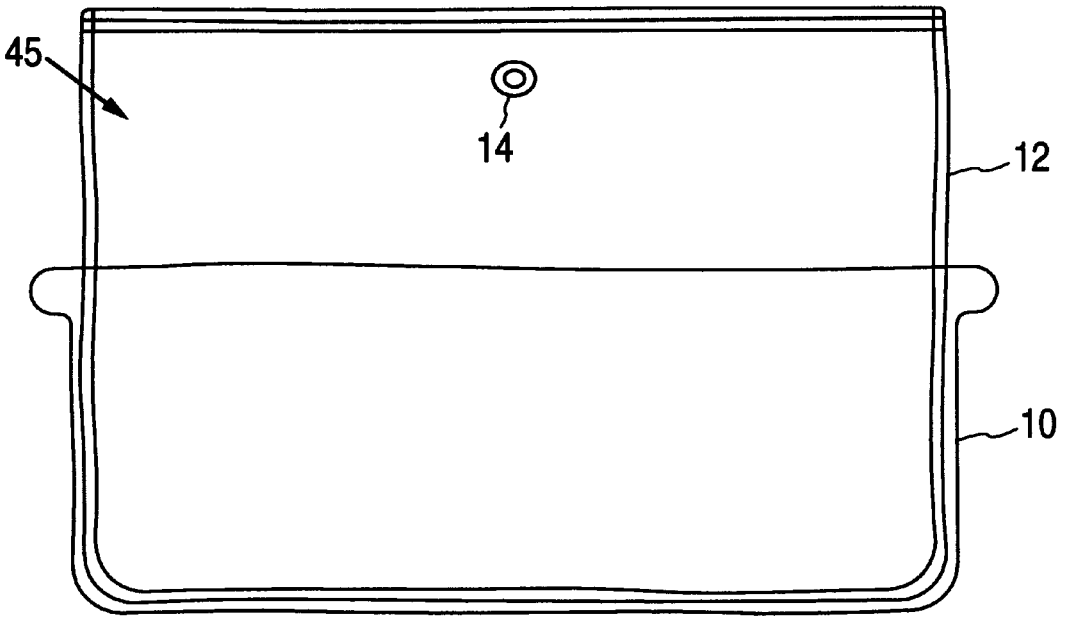
FIG. 9B is a side view of the storage unit illustrating the port attached to the liner only.

The port 14 can be located anywhere on container 10, such as near its top open end 21, as illustrated in FIG. 9A. Alternately, port 14 can be located on just the liner 12, as illustrated in FIG. 9B. This location is advantageous because the port 14 is located completely inside container 10 after air evacuation from liner 12 for better protection. Further, if the liner were to tear or puncture, or the check valve 90 in port 14 were to fail, the liner 12 can be removed from container 10 (assuming an adhesive is used that allows the liner to be forcefully pulled out) and replaced with a new liner.

Figure 10A:
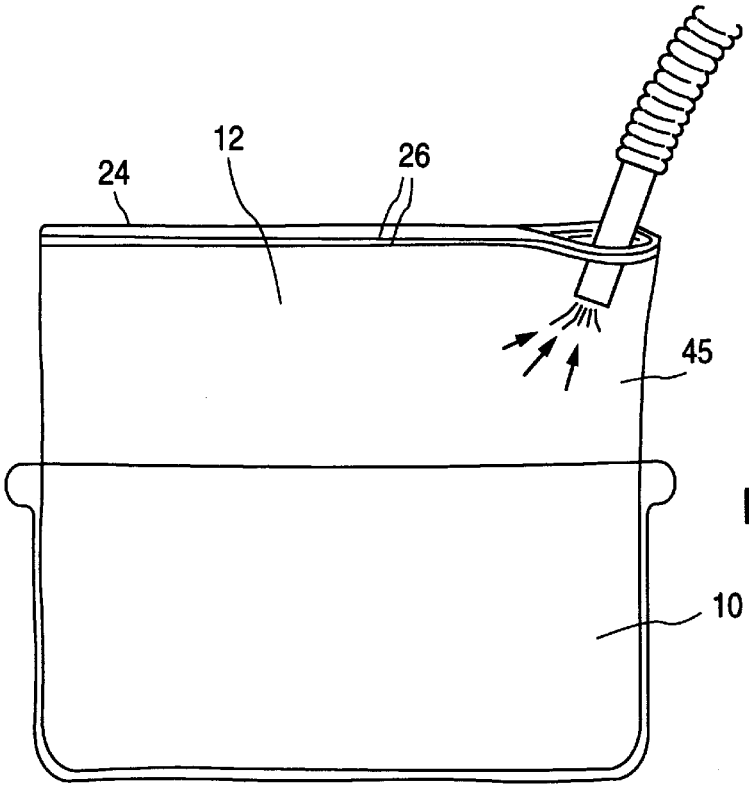
FIG. 10A is a side view of a second alternate embodiment of the storage unit of the present invention, which has no check valve.
Figure 10B:
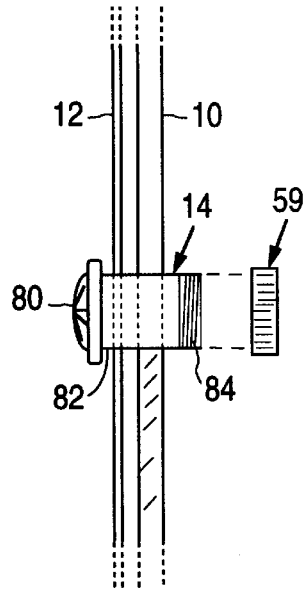
FIG. 10B is a side view of a third alternate embodiment of the storage unit of the present invention, which has an externally sealable port instead of a check valve.

While the check valve 90 in port 14 makes it convenient and easy to evacuate the air from the liner, it is within the scope of the present invention to omit the check valve 90 from the storage unit, as illustrated in FIGS. 10–10B. As illustrated in FIG. 10A, port 14 is eliminated in its entirety. To evacuate air from liner 12, the sealing fasteners 26 are closed except for a small portion just large enough to allow insertion of the cylindrical attachment from the vacuum source. Once the liner 12 is sufficiently evacuated of air, the vacuum source attachment is removed and sealing fasteners 26 are fully closed. FIG. 10B illustrates hollow port 14 without a check valve therein. A screw-on or snap-on cap 59 is used to form the air tight seal at port 14 once the liner 12 has been evacuated of air.

Figure 11:
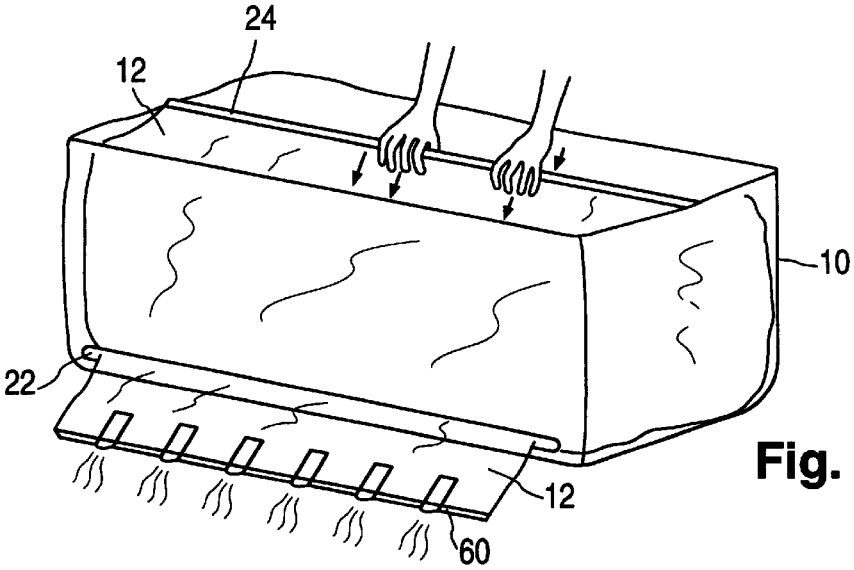
FIG. 11 is a side perspective view of a fourth alternate embodiment of the storage unit of the present invention, which has an elongated aperture formed in the container through which the end of the liner (having a plurality of flat piped check valves) protrudes.

FIG. 11 illustrates an alternate embodiment of the present invention, which uses check valves incorporated into the liner 12 to evacuate air therefrom. Aperture 22 in container 10 is elongated. A portion of liner 12 is exposed by and/or protrudes from aperture 22, and terminates in a plurality of flat-piped check valves 60. Check valves 60 are formed of narrow plastic film pieces that expand apart to let air out of liner 12, but are forced together to form a seal if air attempts to enter liner 12. Examples of flat piped check valves 60 are fully discussed in U.S. Pat. Nos. 5,540,500 and 5,209,264, which are both incorporated herein by reference. With this embodiment, the liner 12 is evacuated of air by pressing the liner down and into the container 10, which forces the air out through check valves 60.

Figure 12A:
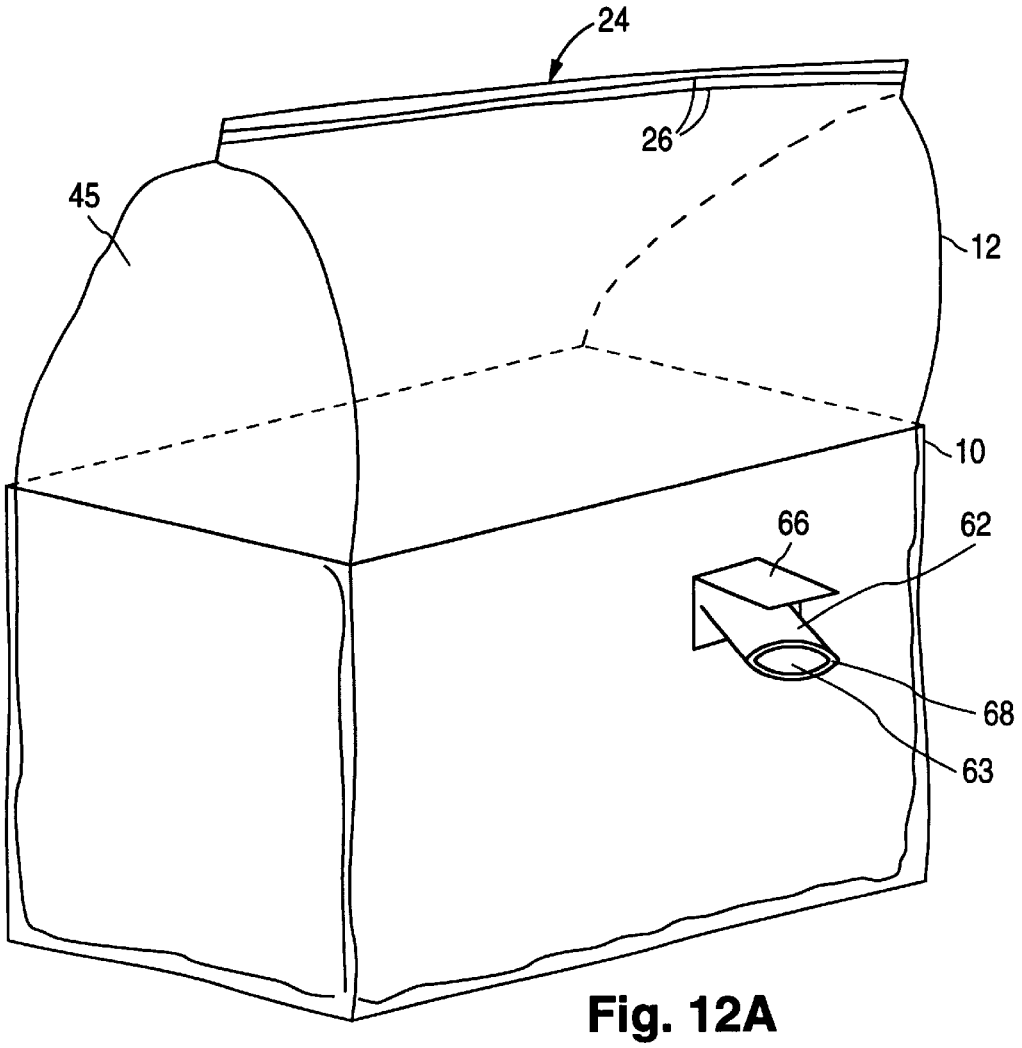
FIGS. 12A–12B are perspective views of a fifth alternate embodiment of the storage unit of the present invention, which includes a tube extending from the liner and exiting the container for evacuating the liner.
Figure 12B:
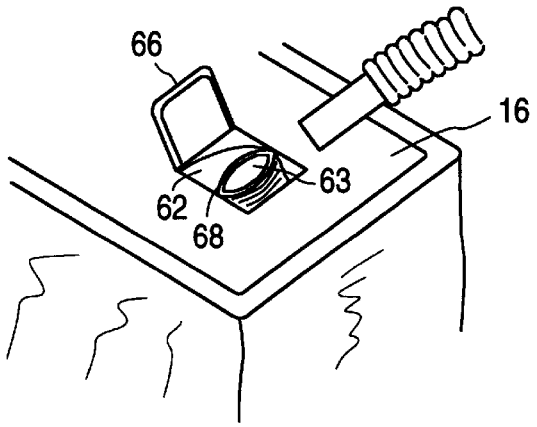

FIGS. 12A and 12B illustrate another alternate embodiment of the present invention. Instead of using a one way valve to evacuate the air from liner 12, a tube 62 attached to aperture 44 in liner 12 protrudes out of container 10 through aperture 22, or out an aperture 64 formed in the lid 16. A hinged door 66 closes over aperture 22 or aperture 64. Tube 62 has an open end 63 that terminates in sealing fasteners 68 similar to the sealing fasteners 26 at the liner open end 24. To evacuate the liner 12, the vacuum source is inserted into tube 62 and activated, or the liner is manually compressed, to evacuate air out tube 62. Then, sealing fasteners 68 are closed, tube 62 is pushed into container 10, and door 66 is closed. The door may also be constructed to close over and pinch off the end of tube 62, thus possibly negating the need for sealing fasteners 68. It should be noted that tube 62 could be sealed by any of the techniques illustrated in FIGS. 6A–6G.

Figure 13:
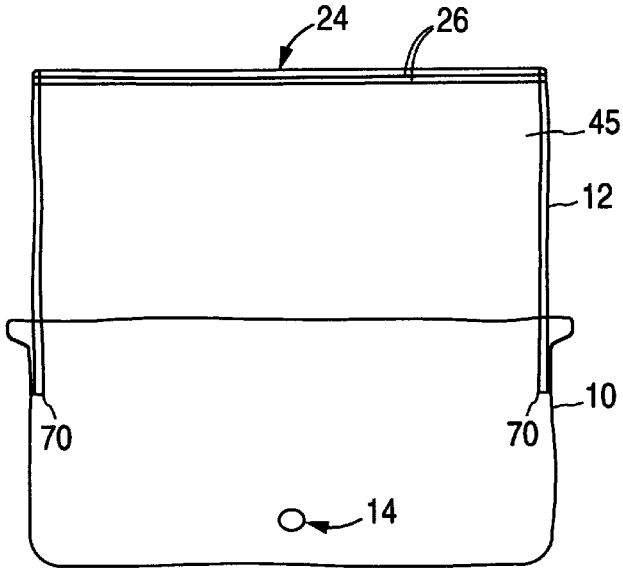
FIG. 13 is a side view of an alternate embodiment of the liner of the present invention, where the liner has a second open end that is attached to the container in an air tight seal.

FIG. 13 illustrates an alternate embodiment for liner 12, which has a lower open end 70 that is attached to walls 20 of container 10 in an air tight manner. With this embodiment, port 14 attaches only to the liner 12, or only to the container 10 (as illustrated in FIG. 13).

Figure 14A:
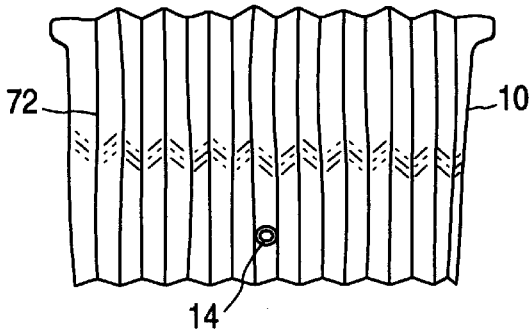
FIGS. 14A–14B are side views of an alternate embodiment of the container of the present invention, where the container is collapsible in an accordion-type manner.
Figure 14B:
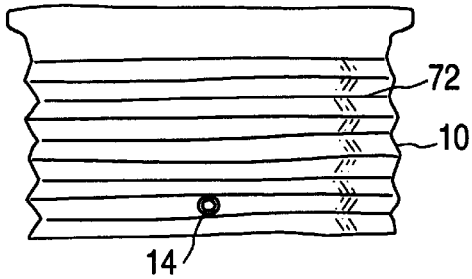

FIGS. 14A–B illustrate an alternate embodiment for container 10, which includes sidewalls 20 having vertical or horizontal folding ridges 72. The container folds up in an accordion type manner in one direction, but still is substantially rigid in another direction to provide the requisite support and protection. This embodiment is ideal for storing articles that are smaller than the expanded volume of the container 10. The container compresses to reduce the overall storage size when smaller articles are stored, but expands to store larger articles that would not otherwise fit into the compressed volume of container 10.

It is to be understood that the present invention is not limited to the embodiments described above and illustrated herein, but encompasses any and all variations falling within the scope of the appended claims. For example, the liner could be attached to container 10 only by port 14, or only by adhesive. The liner could be attached to the container by hook and fabric connectors, or heat sealing to the container bottom/side walls. Container 10 and liner 12 need not be rectangular shaped as shown, but be any shape conducive to compressing and storing articles. The liner volume can be collapsed well below the volume of container 10 so that other articles can be stored on top of collapsed liner 12 inside the container 10. Container 10 can be formed by a box that folds flat with liner 12 inside, for easy transportation and/or storage occupying minimal space when first sold and/or while not in use. Lastly, sealing fastener 26 can be any linear fastener that includes a female fastener member having a linear channel and a male fastener member having a linear protrusion that engages with the channel to provide an airtight seal along the open end 24 of liner 12. An example of such a sealing fastener is disclosed in U.S. Pat. No. 5,689,866, which is incorporated by reference.

What is claimed is:

1. An evacuatable storage unit for storing compressible articles, comprising:

a substantially rigid container having an open tipper end;

a flexible air tight liner attached to an inside of the container, the liner having an upper portion that extends out beyond the open tipper end of the container, the liner upper portion terminates in an opening for inserting compressible articles into the liner, the opening is closable to form an air tight seal;

a port installed in a surface of the liner that allows air to pass out of the liner and prevents air from entering the liner;

wherein as air inside the liner is evacuated from the liner through the port, the liner upper portion and compressible articles stored therein collapse into the container;

the port includes an inlet facing an interior of the liner and an outlet facing the outside of the container;

inlet holes and ridges raised above the inlet holes are formed at the inlet; and a flange is formed at the outlet for engaging a cylindrical attachment from a household vacuum cleaner.

2. The evacuatable storage unit of claim 1, further comprising:

a lid for covering the open upper end of the container.

3. The evacuatable storage unit of claim 1, wherein the port extends through a surface of the container so that air in the liner is evacuated by the port through the liner surface and the container surface.

4. The evacuatable storage unit of claim 1, wherein the port includes a one-way air check valve therein that allows air to pass through the port in one direction away from the liner, and prevents air from passing through the port in an opposite direction toward the liner.

* * * * *